US012070163B2

(12) United States Patent
Zerweck et al.

(10) Patent No.: US 12,070,163 B2
(45) Date of Patent: Aug. 27, 2024

(54) DISPENSER FOR ROLLS OF ABSORBENT PAPER

(71) Applicant: Essity Hygiene and Health Aktiebolag, Gothenburg (SE)

(72) Inventors: Jason Zerweck, Philadelphia, PA (US); Christian Kasilag, Philadelphia, PA (US); Bre Stachowski, Philadelphia, PA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 307 days.

(21) Appl. No.: 17/619,515

(22) PCT Filed: Aug. 30, 2019

(86) PCT No.: PCT/SE2019/050814
§ 371 (c)(1),
(2) Date: Dec. 15, 2021

(87) PCT Pub. No.: WO2021/040593
PCT Pub. Date: Mar. 4, 2021

(65) Prior Publication Data

US 2022/0175200 A1 Jun. 9, 2022

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01)

(58) Field of Classification Search
CPC ..... A47K 10/38; A47K 10/3662; A47K 10/3818; A47K 10/3836; A47K 2010/3253
See application file for complete search history.

(56) References Cited

U.S. PATENT DOCUMENTS 1,016,270 A * 2/1912 Johnson ..... A47K 10/36 226/130
4,375,874 A * 3/1983 Leotta ..... A47K 10/38 242/598.6

(Continued)

FOREIGN PATENT DOCUMENTS

CA 2359128 A1 4/2003
CN 202235110 U 5/2012

(Continued)

OTHER PUBLICATIONS

Notification of the First Office Action issued on Jul. 5, 2022, by the Chinese Patent Office in corresponding Chinese Patent Application No. 201980097625.5, and an English Translation of the Office Action. (14 pages).

(Continued)

*Primary Examiner* — Gene O Crawford
*Assistant Examiner* — Kelvin L Randall, Jr.
(74) *Attorney, Agent, or Firm* — BUCHANAN INGERSOLL & ROONEY PC

(57) ABSTRACT

A dispenser includes a housing, a first support for rotatably supporting a first roll and a second support for rotatably supporting a second roll, the dispenser further including a dispensing opening and a door configured to be movable between a first rest position, in which dispensing of material from the first roll when provided on the first support is hindered by the door, and a second rest position, in which dispensing of material from the second roll when provided on the second support via the dispensing opening is hindered by the door. The dispenser further includes a lever arrangement and a biasing element.

16 Claims, 8 Drawing Sheets

(56) References Cited

U.S. PATENT DOCUMENTS

| | | | | | |
|---|---|---|---|---|---|
| 4,872,601 | A * | 10/1989 | Sigmund | A47K 10/3836 225/80 |
| 5,065,924 | A * | 11/1991 | Granger | A47K 10/3818 225/53 |
| 5,265,816 | A * | 11/1993 | Collins | A47K 10/3836 242/560 |
| 5,645,244 | A | 7/1997 | Moody | |
| 5,762,287 | A * | 6/1998 | Schutz | A47K 10/3818 242/593 |
| 5,954,256 | A | 9/1999 | Niada | |
| 6,364,245 | B1 | 4/2002 | Paal et al. | |
| 10,327,601 | B2 | 6/2019 | Bengtsson et al. | |
| 2005/0167543 | A1* | 8/2005 | Elliott | A47K 10/38 242/596.8 |
| 2007/0152092 | A1* | 7/2007 | Ponka | D21F 1/325 242/383.4 |
| 2008/0156926 | A1 | 7/2008 | Cattacin et al. | |
| 2009/0072072 | A1 | 3/2009 | Elliott et al. | |
| 2015/0327735 | A1 | 11/2015 | Himmelmann et al. | |

FOREIGN PATENT DOCUMENTS

| | | | |
|---|---|---|---|
| CN | 104869880 | A | 8/2015 |
| CN | 108289575 | A | 7/2018 |
| CN | 109528055 | A | 3/2019 |
| DE | 10316790 | A1 | 10/2004 |
| GB | 2269361 | A | 2/1994 |
| JP | 2003339573 | A | 12/2003 |
| WO | 2015001287 | A1 | 1/2015 |

OTHER PUBLICATIONS

International Search Report (PCT/ISA/210) and Written Opinion (PCT/ISA/237) mailed on Mar. 19, 2020, by the Swedish Patent Office as the International Searching Authority for International Application No. PCT/SE2019/050814.

* cited by examiner

DISPENSER FOR ROLLS OF ABSORBENT PAPER

TECHNICAL FIELD

The present disclosure relates to a dispenser for rolls of absorbent paper, the dispenser comprising a housing configured to house at least two rolls. The dispenser comprises a dispensing opening extending along said length dimension, and a door configured to be movable along the dispensing opening.

BACKGROUND

Dispenser for rolls of absorbent paper, such as hygiene paper or wiping paper may comprise a housing configured to house at least two rolls. In such dispensers it may generally be desired that absorbent paper is initially dispensed from one out of the two rolls, and that absorbent paper from the other roll is presented to the user only once the first roll is completely or close to depleted.

To this end, existing dispensers may comprise a dispensing opening extending along the housing and a door arranged so as to be movable along the dispensing opening between two positions in which in which dispensing of material from one of the rolls is hindered by the door, whereas dispensing from the other roll is allowed. Hence, by moving the door between the two positions, it is possible to control which one out of the two rolls is being used. To ensure that absorbent paper is initially dispensed from one out of the two rolls, and that absorbent paper from the other roll is presented to the user only once the first roll is completely or close to depleted, the dispensers may comprise an arrangement for controlling the movement of the door. Such an arrangement may be configured to allow movement of the door from a first position, in which dispensing from one roll is allowed, to a second position, in which dispensing from the other roll is allowed, only once the first mentioned roll is completely or close to depleted.

U.S. Pat. No. 6,364,245 relates to a dispenser for selectively dispensing first and second rolls of sheet material. The dispenser includes a housing defining a storage compartment for the first and second rolls and an opening, and a divider slidably carried by the housing and covering a portion of the opening. The divider is movable between a first dispensing position, wherein a first portion of the opening is uncovered to allow access to the first roll, and a second dispensing position, wherein a second portion of the opening is uncovered to allow access to the second roll. The divider includes an adjustable blocking plate for preventing movement of the divider from the first dispensing position to the second dispensing position until substantially all the sheet material has been exhausted from the first roll.

US 2009/0072072 relates to a paper dispenser comprising a housing having a first dispenser roll support and a second reserve roll support, and a door movable between a first position and a second position, the door providing access to a dispensing paper roll mounted on the first dispenser roll support when positioned in the first position, the door providing access to a second reserve paper roll mounted on the second reserve roll support when positioned in the second position. The first dispenser roll support prevents the door from moving to the second position until the dispensing paper roll is at least substantially depleted.

Since the dispensers will be used in public environments, they will be handled by many different users perhaps not being acquainted with the function of the movable door. For example, a user may attempt forcing the door to move before the first roll is depleted.

It is desired to provide a dispenser comprising a door as set out in the above, which dispenser is easy to use and/or to refill. Also, it is desired to provide a dispenser which is advantageous from a manufacturing and/or cost perspective.

SUMMARY

The dispenser may be used for housing rolls having a core or for coreless rolls. The rolls may comprise absorbent paper or other web-shaped rolled up material.

Hence, there is provided a dispenser for rolls of absorbent paper, the dispenser comprising a housing configured to house at least two rolls and defining a length dimension and a width dimension, perpendicular to the length dimension.

The housing comprises a first support, for rotatably supporting a first roll, and a second support, for rotatably supporting a second roll, the first and second supports being spaced apart from each other as seen along the length dimension. The dispenser further comprises a dispensing opening extending along the length dimension, and a door arranged in relation to the dispensing opening.

With "support" is meant herein a device or a portion of a device arranged for rotatably supporting a roll. Optionally, the support(s) may be configured for supporting a roll by contact with an inner diameter of said roll, i.e. by the roll being threaded over the support. Optionally, the support(s) may have a generally cylindrical shape.

Optionally, the first and/or second supports extend primarily along said width dimension. That is to say that, if a vector along the longitudinal extension of the support is expressed in terms of a length vector, a height vector, and a width vector, for each support, no other vector will be greater than the width vector.

Optionally, the first and/or second supports may extend generally parallel to the width dimension.

As mentioned in the above, the first and second supports are configured for rotatably supporting a first and a second roll, respectively. As such, the first and second supports may be configured for rotatably supporting a first and a second roll, respectively, about a first and a second support axis.

Optionally, the first and/or second support axes extend primarily along said width dimension. That is to say that, if a vector along the respective axis is expressed in terms of a length vector, a height vector and a width vector, for each axis, no other vector will be larger than the width vector.

Optionally, the first and/or second support axes may be generally parallel to the width dimension.

That the supports are to rotatably support the first and second roll about the first/second support axis is to be understood to encompass that the first and second roll are rotatably supported so as to rotate generally about said first and second support axis, respectively. Since the rolls will be subject to gravity when arranged on the supports, the centre axis of the rolls might not exactly coincide with the first and second support axis.

In the first rest position, dispensing of material from the first roll when provided on the first support is hindered by the door. Also, when the door is in the first rest position, dispensing of material from the second roll, when provided on the second support, may be allowed.

Correspondingly, in the second rest position, dispensing of material from the second roll when provided on the second support via the dispensing opening is hindered by the door. Also, when the door is in the second rest position, dispensing of material from the first roll, when provided on the first support, may be allowed.

The dispenser further comprises a lever arrangement and a biasing element.

The lever arrangement may comprise a lever being configured to be pivotable about a pivot axis, which pivot axis is fixedly arranged in relation to the housing, at a position between the first and second supports as seen along the length extension.

The biasing element may be configured to urge the lever towards an home position, and the lever may be configured to be pivotable against the bias of the biasing element from the home position to a first end position, in which a minimum radius from the first support to the lever is shorter than in the home position, and the lever may be configured to be pivotable against the bias of the biasing element from the home position to a second end position, in which a minimum radius from the second support to the lever is shorter than in the home position.

With "home position" is herein meant a position assumed by the lever when the lever arrangement is not subject to any external force. If the lever is released from a biased position, it will hence automatically return to the home position.

To determine a radius from a first or second support to the lever, what is to be considered is a distance to a minimum imaginary cylinder which encloses the support.

Such a minimum imaginary cylinder enclosing the support may generally extend at least along the width direction W.

Optionally, a minimum imaginary cylinder enclosing the support may extend parallel to the width direction W.

Optionally, the centre axis of such an imaginary cylinder may coincide with the centre support axis of the support.

The minimum radius from the first or second support to the lever is to be understood as being the shortest distance between such an imaginary cylinder enclosing the first/second support to any point on the lever.

Optionally, the lever may be configured to be pivotable in a direction towards a roll supporting surface of the first and second support. I.e. the lever will, when the dispenser is in use, be pivotable from the home position towards the outer cylindrical surface of a roll arranged on the support.

Optionally, the lever may be configured to be pivotable in a direction substantially perpendicular to the longitudinal extension of said minimum imaginary cylinder.

The dispenser may further comprise a mechanical connection arrangement between the door and the lever arrangement.

The mechanical connection arrangement may be configured such that when the door is in the first rest position, the lever is in the home position, and when the door is in the second rest position, the lever is in the home position, Accordingly, when the door is in one out of its two rest positions, the door will remain in that position unless moved by an external force.

Movement of the door from the first rest position to the second rest position along the dispensing opening is linked to pivoting the lever against the bias of the biasing element from the home position to the second end position, and subsequently releasing the lever to reassume the home position. Correspondingly, movement of the door from the second rest position to the first rest position along the dispensing opening is linked to pivoting the lever against the bias of the biasing element from the home position to the first end position, and subsequently releasing the lever to reassume the home position.

That the movement of the door is linked to the pivoting of the lever means that the movement of the door implies and requires the pivoting of the lever. In other words, the connection arrangement is configured to translate the movement of the door along the dispensing opening into pivotable movement of the lever, and vice versa.

The mechanical connection arrangement may hence provide for connection between the movement of the door along the dispensing opening and the pivotal movement of the lever of the lever arrangement.

In the first rest position, the mechanical connection arrangement may provide for a mechanical connection between the door and the lever which allows for the lever to be in its home position. Alternatively, the mechanical connection arrangement may provide for that the door is free from connection to the lever in the first rest position, i.e. the mechanical connection releases the connection between the door and the lever. In either case, the lever will, when the door is in the first rest position, be in its home position. The door will be free from any bias from the biasing element and may rest freely in the first rest position.

If a user pulls the door from the first rest position towards the second rest position, the mechanical connection arrangement between the door and the lever will transfer said movement to a pivoting movement of the lever towards the second support. Since the movement of the door is linked to the pivoting of the lever, it is understood that the door may only be moved as far as the lever is able to pivot inside the dispenser. As soon as the lever starts pivoting towards the second support, the minimum radius between the second support and the lever is diminished. Accordingly, any absorbent paper material remaining on the second roll will block further pivoting of the lever towards the second support, and consequently hinder further movement of the door towards the second rest position. When the remaining paper material of the second roll is sufficient to hinder the lever from reaching the second end position (i.e. generally when the radius of the remaining amount of material on the second roll is greater than the minimum radius between the second support axis and the lever in the second end position), the door will hence be in a position between the first and second rest positions, and not be further movable towards the second rest position. If the door is released from this position, the lever, being in a biased position in the housing, will move to reassume its home position. The mechanical connection between the door and the lever provides for that when the lever moves towards its home position, the door is moved back to the first rest position.

Hence, an attempt to move the door towards the second rest position before the second roll is sufficiently depleted, will lead to automatic return of the door to the first rest position.

However, when the second roll is sufficiently depleted, the material of the roll will not hinder movement of the lever to the second end position. The mechanical arrangement between the lever arrangement and the lid is configured such that further movement of the lid towards the second rest position allows the lever to assume the home position.

Hence, when the second roll is sufficiently depleted, moving the door from the first rest position to the second rest position implies moving the lever towards the second end position and subsequently to release of the lever to assume the home position. As stated in the above, in the second rest position, the door will rest without any impact from the biasing element.

The above applies correspondingly when the lid is to be moved from the second rest position to the first rest position.

Hence, the function of a dispenser as described in the above when in use and containing a first and a second roll, may be described as follows:

When the remaining material of the second roll is sufficient to hinder the lever arrangement from reaching the second end position, the door is hindered from continued movement towards the second rest position and is urged towards the first rest position by the biasing element; and when the second roll is depleted to an extent so as to allow the lever to reach the second end position, further movement of the door towards the second rest position is allowed and implies release of the biasing element and return of the lever to its home position, while the door reaches the second rest position.

Correspondingly, when the remaining material of the first roll is sufficient to hinder the lever arrangement from reaching the first end position, the door is hindered from continued movement towards the first rest position and is urged towards the second rest position by the biasing element; and when the first roll is depleted to an extent so as to allow the lever to reach the first end position, further movement of the door towards the first rest position is allowed and implies release of the biasing element and return of the lever to its home position, while the door reaches the first rest position.

The minimum radius from the first support to the lever when the lever is its first end position will hence correspond approximately to the thickness of a roll which is regarded as depleted. This thickness may correspond to the thickness of a core (if present) and possibly some remaining material of the roll. Generally, this minimum radius would be at least the thickness of the core for the cases where rolls with cores are to be used in the dispenser. However, for coreless rolls, this minimum radius could be selected to be zero.

Similarly, if regarding the radius from the first support axis to the lever when the lever is in its first end position, this radius will correspond approximately to the radius of a roll which is regarded as depleted. Generally, this minimum radius from the first support axis would be at least the radius of the core for the cases where rolls with cores are to be used in the dispenser.

Optionally, in case the dispenser is intended for use with coreless rolls, the minimum radius from the first support to the lever when the lever is in its first end position could be zero, i.e. the lever contacts the first support.

Optionally, in case the dispenser is intended for use with coreless rolls, the minimum radius from the first support to the lever when the lever is its first end position could be such that the lever may pass the first support.

The minimum radius from the first support to the lever when the lever is in its home position, will correspond to a maximum thickness of a roll which may fit into the dispenser.

Similarly, if regarding a radius from the first support axis to the lever when the lever is in its home position, this measure will correspond to a maximum radius of a roll which may fit into the dispenser.

With thickness of a roll is meant in the above a distance between the inner radius of the roll (e.g. the inner radius of a core) and an outer radius of the roll.

The above description regarding the minimum radius from the first support to the lever and the first end position applies mutatis mutandis to the minimum radius from the second support to the lever, and the second end position.

The relationship between the minimum radius from the first/second support to the lever when in the first/second end position visavi the minimum radius from the first/second support to the lever when in the home position may hence correspond to an amount of consumption of a roll before it is regarded as depleted.

Optionally, a ratio between the minimum radius from the first support to the lever when the lever is in its first end position, and said minimum radius when the lever is in the home position, is less than 10%, preferably less than 5%, most preferred less than 1%, and/or a ratio between the minimum radius from the second support to the lever when the lever is in its second end position, and said minimum radius when the lever is in the home position, is less than 10%, preferably less than 5%, most preferred less than 1%.

The ratio between the minimum radius from the first/second support to the lever when the lever is in the first/second end position, and the minimum radius from the first/second support to the lever when the lever is in its unbiased position hence expresses the ratio between the thickness of a roll deemed depleted (or close to depleted), and thickness of a new, unused roll.

The difference between the minimum radius from the first/second support axis to the lever when the lever is in the home position, and the minimum radius from the first/second support axis to the lever when the lever is in its first/second end position hence expresses the difference between the radius of a new, unused roll, and the radius of a roll deemed depleted (or close to depleted).

The percentages may be selected so as to reflect the extent to which a first used roll should be depleted before dispensing from the second roll is allowed. It may be noted, that with the proposed dispensers, relatively low percentages may be achieved as compared with what is required for known prior art dispensers. Low percentages would indicate that a high amount of material has been used before the roll is deemed to be depleted.

If the rolls to be used with the dispensers are coreless, the above-mentioned ratio could even be 0%. This would indicate that the roll is completely used up, and that there is no core remaining on the support.

Optionally, the door and the lever arrangement may constitute the mechanical connection arrangement.

Using the door and the lever arrangement to constitute the mechanical connection arrangement enables variants with an efficient use of the parts of the dispenser.

Optionally, the mechanical connection arrangement comprises a cam surface and a cam follower.

Optionally, the mechanical connection arrangement comprises a cam surface associated with the door and a cam follower associated with the lever.

Optionally, the cam surface extends along the length dimension of the dispenser.

The cam surface may be designed to accomplish the desired connection between linear movement of the door along dispensing opening and pivotal movement of the lever of the lever arrangement.

Optionally, the cam surface comprises, as seen along the length dimension, at least one ramp surface for accomplishing the pivoting of the lever from the home position towards the first or second end position.

Optionally, the cam surface comprises, as seen along the length dimension, a first ramp surface for accomplishing the pivoting of the lever from the home position towards the first or second end position, and a second ramp surface for accomplishing the pivoting of the lever from the home position towards the second end position.

Optionally, the cam surface further comprises a dwell surface extending between the first and second ramp surfaces.

With ramp surface is meant a surface being inclined in relation to the intended direction of movement of the cam, i.e. in relation to the intended direction of movement of the door, generally being the length direction of the housing. Such a ramp surface may cooperate with the cam follower so as to provide for pivoting of the lever.

With dwell surface is meant a surface being generally parallel to the intended direction of movement of the cam, i.e. in relation to the intended direction of movement of the door, generally being the length direction of the housing. Such a dwell surface may cooperate with the cam follower so as to provide for a maintained position of the lever. As such, a dwell surface may be used to provide for the lever being maintained in a pivoted position, e.g. the first or second end position, while the door is moved along the dispensing opening.

Optionally, the door comprises a door portion extending essentially in a plane along the length and width dimensions, and a cam portion extending essentially in a plane along the length and height dimensions, the cam portion comprising the cam surface.

Optionally, in the home position, the lever extends from the pivot axis and substantially along a height dimension, perpendicular to the length dimension and width dimension.

In other words, in the home position, the lever may form an angle with the length dimension being about 90 degrees.

Hence, the lever may extend between the two rolls as provided on the roll supports.

Optionally, in the home position, the lever may extend along the height direction of the dispenser, at least to a position between the first and second supports.

Optionally, the pivot axis is located centrally between the first and second supports, as seen along the length dimension.

Optionally, the pivot axis extends primarily along said width direction of the dispenser.

Optionally, the pivot axis extends generally along said width direction of the dispenser.

Optionally, the pivot axis is arranged between the dispensing opening and the first and second supports, as seen along the height dimension.

Optionally, the pivot axis extends in a direction other than parallel to said length dimension of the dispenser.

This provides for useful options for forming the mechanical connection arrangement between the door and the lever arrangement.

Optionally, the lever extends between two end portions, and is connected to the pivot axis at one of the two end portions, the lever preferably being configured as a straight bar.

Optionally, the biasing element comprises a spring element.

The biasing element may provide for an home position of the associated lever when the biasing element is relaxed. Pivoting of the associated lever in either direction from the unbiased may result in the biasing element becoming compressed or elongated, creating a biasing force acting on the lever.

Optionally, the biasing element comprises a compression spring.

Optionally, the compression spring is arranged to be compressed upon pivoting of the lever towards the first end position or towards second end positions.

Optionally, the compression spring is arranged to be compressed in a direction along the pivot axis upon pivoting of the lever about said pivot axis towards the first or second end positions.

Optionally, the biasing arrangement comprises a plunger arranged to be displaceable along the pivot axis upon pivoting of the lever about said pivot axis.

Optionally, the biasing arrangement comprises plunger arranged to compress the biasing element along the pivot axis upon pivoting of the lever towards the first or second end positions.

Optionally, the biasing arrangement comprises one or more torsion springs.

In another aspect there is provided a dispenser as described in the above comprising at least one, preferably two rolls of absorbent paper.

With the term "lever" herein is meant a device performing the function of a lever, i.e transferring pivoting movement/forces.

Optionally, the lever may comprise one single member.

Optionally, the lever may comprise several members, for example several interconnected members.

Numerous options are available for design of the lever members.

Optionally, the lever may comprise an elongated bar.

Optionally, the lever may comprise a generally planar surface.

Generally it is disclosed herein a dispenser configured to house at least two rolls of absorbent paper, the dispenser comprising a door arranged to be movable along a dispensing opening between two rest positions for alternatively allowing and hindering dispensing from either of said two rolls. The dispenser is provided with a lever arrangement, a biasing element, and a mechanical arrangement interconnecting the door with the lever arrangement such that when moving the door from one rest position towards the other rest position, material remaining on the roll from which dispensing is currently allowed, will hinder further movement of the lever arrangement, causing the biasing element to urge the door back towards the initial rest position, and, when the roll from which dispensing is currently allowed is depleted, the lever arrangement will be able to move freely, enabling movement of the door all the way from the initial rest position to the other rest position.

Hence, automatic return of the door when moved away from one of its rest positions before depletion of the currently used roll is enabled.

Moreover, once the door is moved from an initial rest position to another rest position, the lever arrangement is automatically reset such that the dispenser displays the same functions when the door is to be moved from said other rest position towards the initial rest position.

A dispenser according to this general disclosure may be enabled by a skilled person using some or all of the features explained in the above, and in the following detailed description.

However, it will be understood that other options are available.

For example, a lever arrangement using other than one single lever may be used. In this case, the references to the lever in the above disclosure, e.g. when referring to the movement between the end positions and the minimum radiuses, could instead be made to the lever arrangement, as will be understood by those skilled in the art.

For example, one skilled in the art could use two levers in the lever arrangement instead of one. In such a dispenser, optionally one lever could be pivotable towards one end position, whereas the other lever could be pivotable towards the other end position.

For example, one skilled in the art could apply the general concept to a dispenser wherein the supports for rolls are arranged in other than the width direction and perpendicular to the dispensing opening.

In another aspect, there is provided a method for the setting a of a dispenser in accordance to the previous claims, from a first state allowing dispensing from a first roll of absorbent paper material supported by the first support to a second state allowing dispensing from a second roll of absorbent material, supported by the second support, the method comprising moving the door from the second rest position towards the first rest position implying the pivoting of the lever against the bias of the biasing element such that the lever is urged towards the first end position, and, when the remaining amount of rolled absorbent paper of the first roll provided on the first support has a radius from the first support being less than the minimum radius between the first support and the lever when in the first end position, such that the lever reaches the first end position, continuing moving the door towards the first rest position, implying that the lever reassumes the home position and the door reaches the first rest position, enabling dispensing from the second roll arranged on the second support via the dispensing opening.

Optionally, the method comprises the additional step of arranging a new first roll on the first support while the door remains in the first rest position.

Further options and advantages of the dispenser as disclosed herein are disclosed in the following description.

BRIEF DESCRIPTION OF THE DRAWINGS

Below follows a more detailed description of preferred embodiments of the dispensers with reference to the appended drawings, wherein.

DETAILED DESCRIPTION OF PREFERRED EMBODIMENTS

Figure 1:
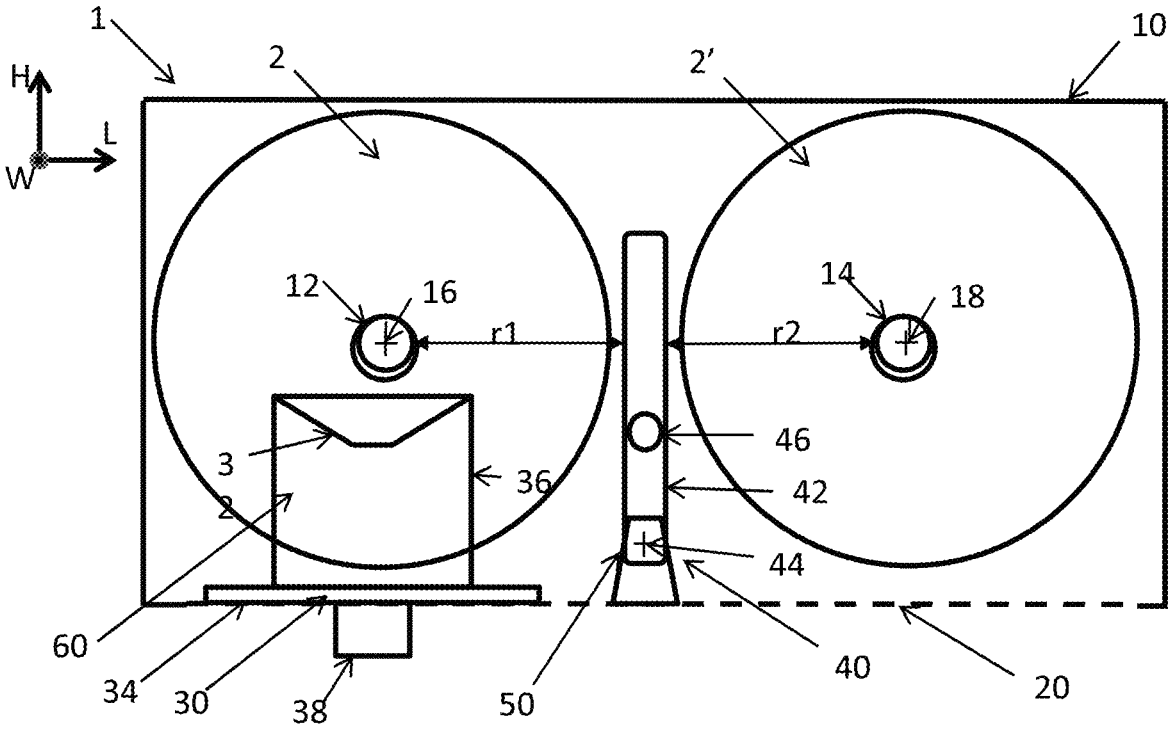
FIG. 1 illustrates schematically a variant of a dispenser when the door is in a first rest position, in which dispensing from a first roll contained in the dispenser is hindered, whereas dispensing from a second roll contained in the dispenser is allowed.

FIG. 1 illustrates schematically a variant of a dispenser 1 for two rolls 2, 2' of web-shaped, rolled up material, e.g. absorbent paper.

The dispenser 1 comprises a housing 10 configured to house at least two rolls 2, 2' and defining a length dimension L and a width dimension W, perpendicular to the length dimension L. Naturally, the housing 10 will extend also along a height direction H, perpendicular to said length L and width W dimensions. It is to be understood that the terms length, height and width regarding the dimensions does not imply that the dispenser 1 must be arranged in any particular direction visavi the ground.

However, the dispenser may optionally be configured to be arranged such that the length dimension L extends generally horizontally and the height dimension H extends generally vertically. To this end, the dispenser may comprise suitable connectors e.g. apertures enabling the attachment of the dispenser 1 to a wall.

The housing 10 comprises a first support 12 extending along a first support centre axis 16 in the width dimension W, and a second support 14 extending along a second support centre axis 18 in the width dimension W.

The first support 12 is configured for rotatably supporting a first roll 2 about said first support axis 16. Correspondingly, the second support 14 is configured for rotatably supporting a second roll 2' about said second support axis 18.

The first and second supports 12, 14 may optionally and as illustrated in FIG. 1 have a generally circular cross-section. For example, the first and second supports 12, 14 may be configured as mandrels.

The first and second supports 12, 14 with the first and second support axes 16, 18 are spaced apart from each other as seen along the length dimension (L). This implies that the two rolls 2, 2' may be arranged side-by-side as seen along the length dimension L.

Optionally, and as illustrated in FIG. 1, the first and second supports 12, 14 may be positioned on the same level as seen in the height direction H.

The dispenser further comprises a dispensing opening 20 extending along the length dimension L.

The dispensing opening 20 may be formed in various manners. For example, the housing 10 may form the entire dispensing opening 20, i.e. the housing 10 surrounds the dispensing opening 20 completely. In another example, the housing 10 may form only a part of the dispensing opening 20, i.e. the housing surrounds the dispensing opening only partially.

Although not depicted in FIGS. 1 to 9, the dispenser may comprise a cover configured to cooperate with the housing 10. Such a cover may be configured to cover the space comprising the supports 12, 14, and hence protect the rolls 2, 2' from access other than via the dispensing opening 20. To this end, the cover may be configured to be lockable. In this alternative, it may be envisaged that only an attendant user is able to unlock the cover and open the dispenser, for example for replacing a depleted roll with a new roll. When the rolls are to be replaced, access to the supports 12, 14 generally along the width dimension W may be provided by removing said cover from the housing 10.

Optionally, the cover may form the dispensing opening 20. In another option, the dispensing opening 20 may be formed between the cover and the housing 20.

Optionally, and as depicted in FIG. 1, the dispensing opening 20 is open to the interior of the housing 10 generally along the height dimension 10.

The dispenser 1 further comprises a door 30 arranged in relation to the dispensing opening 20. The door 30 is configured to be movable along the length extension (L) between a first rest position and a second rest position.

When the door 30 is in the first rest position, dispensing of material from the first roll 2 when provided on the first support 16 is hindered by the door 30, as illustrated in FIG. 1. However, when the door 30 is in the first rest position, dispensing of material from the second roll 2' is enabled via the dispensing opening 20.

Figure 4:
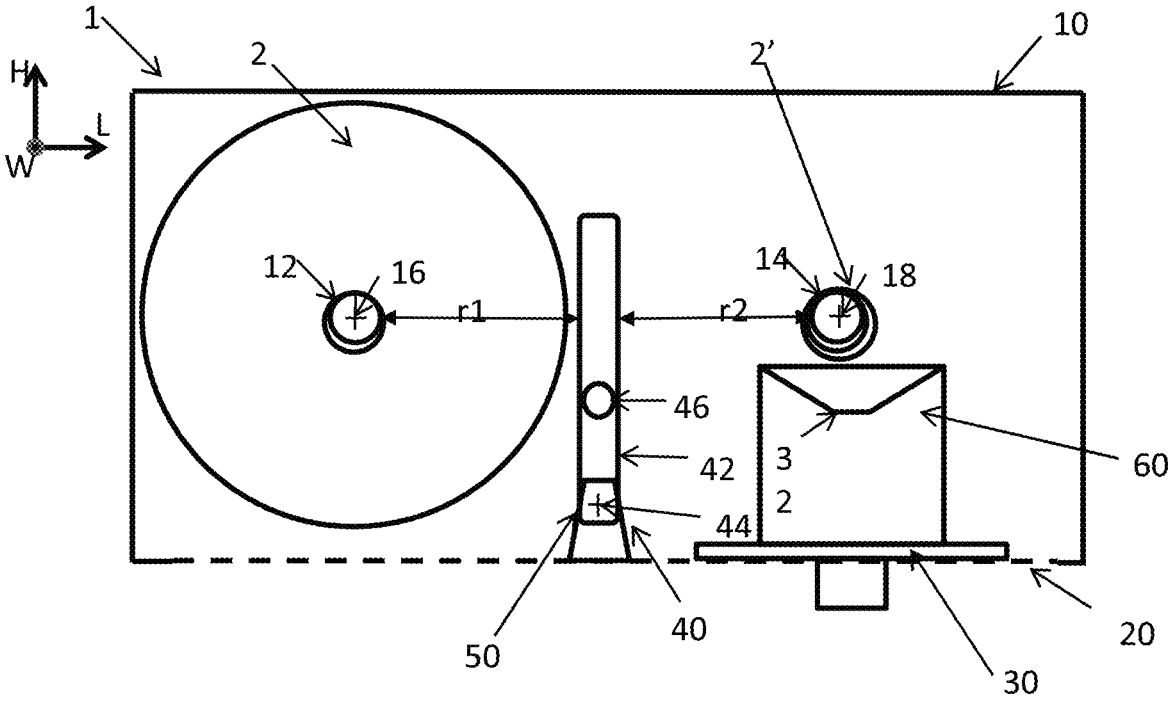
FIG. 4 illustrates the dispenser of FIGS. 1 to 3, when the door is in the second rest position, in which dispensing from the first roll contained in the dispensing is allowed.

Correspondingly, when the door 30 is in the second rest position, dispensing of material from the second roll 2' when provided on the first support 16 is hindered by the door 30. (This second rest position is illustrated in FIG. 4, although with a depleted second roll 2'.). However, when the door 30 is in the second rest position, dispensing of material from the first roll 2 is enabled via the dispensing opening 20.

The dispenser 1 further comprises a lever arrangement 40 comprising a lever 42 and a biasing element 50.

The lever 42 is configured to be pivotable about a pivot axis 44, which pivot axis 44 is fixedly arranged in relation to the housing 10, at a position between the first and second supports 12, 14 as seen along the length extension L.

Optionally, and as illustrated in FIG. 1, the lever 42 extends between two lever end portions, and is connected to the pivot axis 44 at one of the two lever end portions.

Optionally, and as illustrated in FIG. 1, the lever 42 comprises a single lever member. Optionally, and as illustrated in FIG. 1, the lever 42 may be have an elongated configuration, as seen in a plane perpendicular to the width dimension W. Optionally, and as illustrated in FIG. 1, the lever 42 may be configured as a straight bar.

In the variant illustrated in FIG. 1, the pivot axis is fixedly arranged at a position centrally between the first and second supports 12, 14 (and support axes (16, 18). Optionally, and as illustrated in FIG. 1, the pivot axis 44 extends generally along the width dimension W of the dispenser. Optionally, and as illustrated in FIG. 1, the pivot axis 44 is arranged between the dispensing opening 20 and the first and second supports (12,14), as seen along the height dimension H.

The biasing element 50 is configured to urge the lever 42 towards an home position. Accordingly, the home position is a position which the lever 42 strives to reassume when moved from the home position. However, when in the home position, a force will have to be applied against the biasing force created by the biasing element 50 in order to move the lever 42 away from the home position.

Optionally, and as illustrated in FIG. 1, in the home position, the lever 42 extends from the pivot axis 44 and substantially along a height dimension H, perpendicular to the length dimension L and width dimension W. In other words, in the home position, the lever 42 may form an angle with the length dimension L being about 90 degrees.

Hence, the lever may in the home position extend at least partially between the two rolls 2, 2' as provided on the roll supports 12, 14.

Optionally, and as illustrated in FIG. 1, in the home position, the lever may extend along the height direction H of the dispenser 1, at least to a position between the first and second supports 12, 14.

In FIG. 1, details of the biasing element 50 are omitted. However, various types of biasing elements may be used. Optionally, the biasing element may comprise a torque spring, applied to the lever 42 for example at its connection to the pivot axis 44.

The lever 42 is configured to be pivotable against the bias of the biasing element 50 from the home position to towards the second support 14, all the way to a second end position. The dispenser of FIG. 1 with the lever 42 in the second end position is illustrated in FIG. 3.

Figure 3:
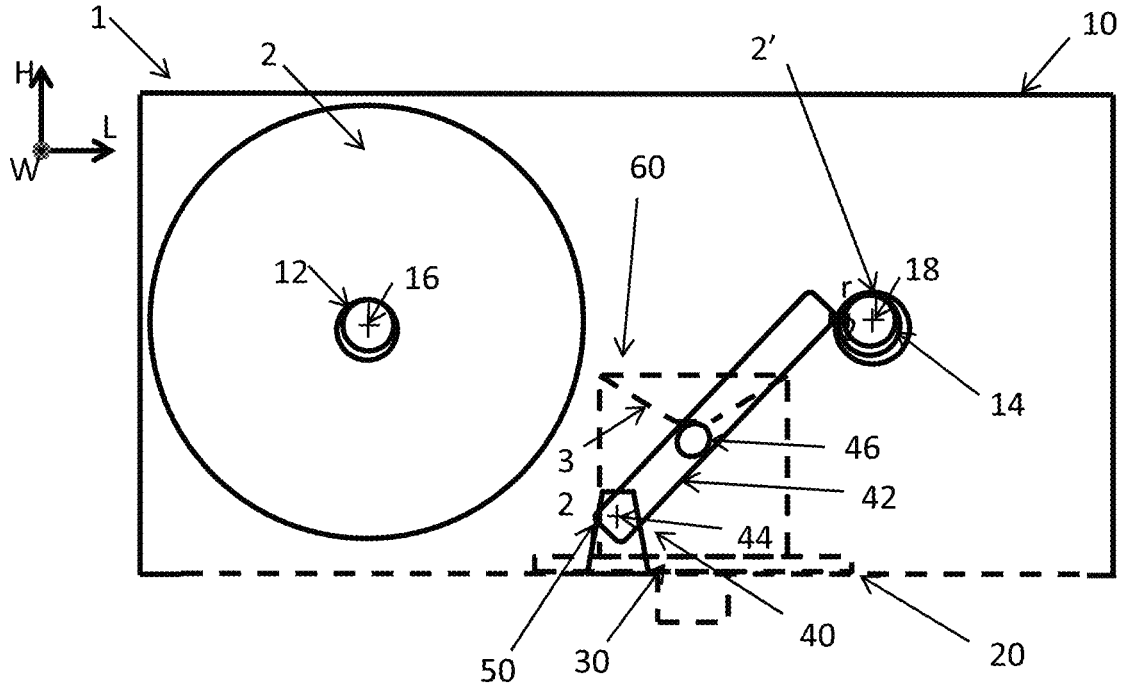
FIG. 3 illustrates the dispenser of FIGS. 1 and 2, when the door is being moved towards the second rest position, and further movement is enabled due to the second roll being substantially depleted.

As may be gleaned from FIG. 3, in the second end position, a minimum radius r2 from the second support 14 to the lever 42 is shorter than in the home position (see FIG. 1).

Correspondingly, although not depicted in the Figures, the lever 42 is configured to be pivotable against the bias of the biasing element 50 from the home position to towards the first support 12, all the way to a first end position. In the first end position, a minimum radius r1 from the first support 12 to the lever 42 is shorter than in the home position.

The dispenser further comprises a mechanical connection arrangement 60 between the door 30 and the lever arrangement 40.

Optionally, and as illustrated in FIG. 1, the door 30 and the lever arrangement 40 are configured to provide the mechanical connection arrangement 60.

Optionally, and as illustrated in FIG. 1, the mechanical connection arrangement 60 comprises a cam surface 32 and a cam follower 46. In the variant illustrated in FIG. 1, the cam surface 32 is associated with the door 30 and the cam follower 46 is associated with the lever 42.

The mechanical connection arrangement 60 is configured such that when the door 30 is in the first rest position (as in FIG. 1), the lever 42 is in the home position. Also, when the door 30 is in the second rest position (as in FIG. 4), the lever 42 is in the home position. Accordingly, when the door 30 is in the first or second rest position, there is no biasing force from the biasing element striving to move the door 30 along the dispensing opening. Instead, the door 30 may rest in either of these rest positions.

Moreover, the mechanical connection arrangement 60 is configured such that movement of the door (30) from the first rest position to the second rest position along the dispensing opening 20 is connected to pivoting the lever 42 against the bias of the biasing element 50 from the home position to the second end position, and subsequently releasing the lever 42 to reassume the home position.

This may be explained with reference to the variant described in the Figures as follows. As already explained in the above, FIG. 1 illustrates a variant of a dispenser 1 when the door 30 is in a first rest position, in which dispensing from a first roll 2 contained in the dispenser 1 is hindered, whereas dispensing from a second roll 2' contained in the dispenser is allowed. The first roll 2 is arranged on the first support 12, and the second roll 2' is arranged on the second support 14, as previously explained. FIG. 1 is understood to illustrate an initial state of the dispenser 1, where both of the rolls 2, 2' are unused, and hence exhibit an initial roll ratio.

After some use of the dispenser with the door 30 in the first rest position as illustrated in FIG. 1, some of the material initially contained on the second roll 2' will have been used up. In other words, the radius of the second roll will now be less than in an initial state, although the second roll 2' is not yet depleted. In this situation, it is still not desired that a user should move the door 30 from the first rest position to the second rest position. Instead, it is desired that the door 30 maintains in the first rest position until the second roll 2' is substantially depleted.

Figure 2:
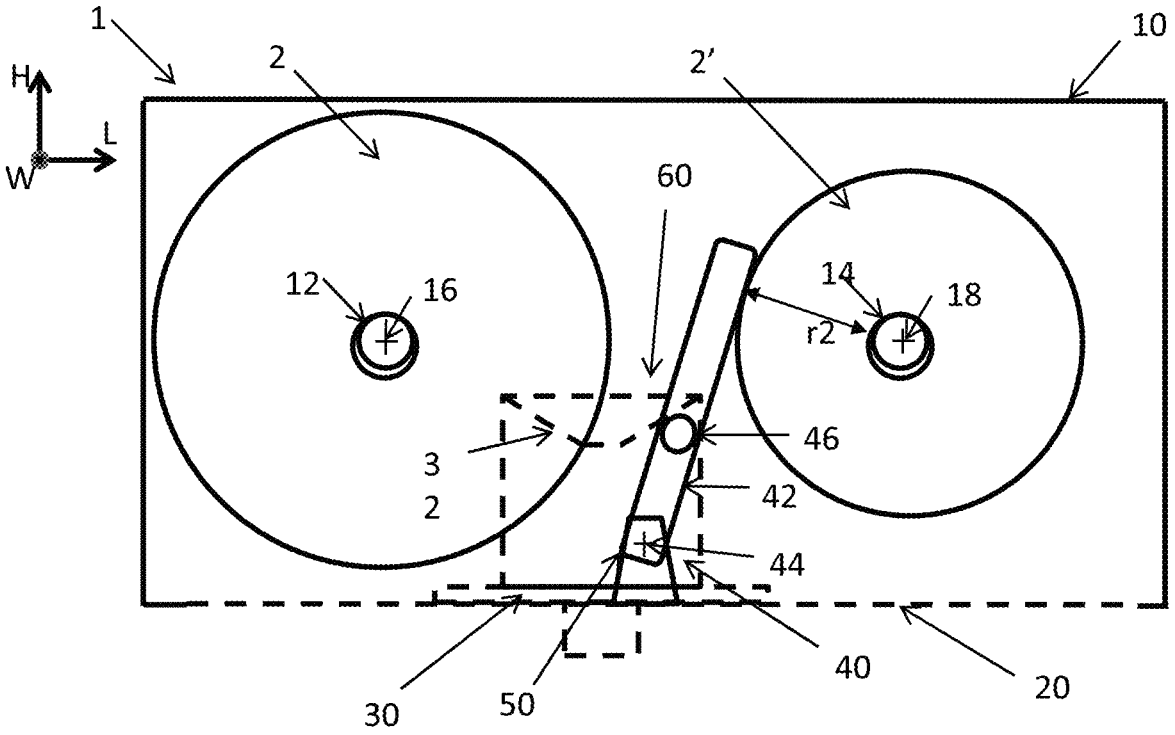
FIG. 2 illustrates the dispenser of FIG. 1 when the door is being moved towards the second rest position, but further movement is hindered due to the amount of material still remaining on the second roll.

FIG. 2 illustrates the dispenser of FIG. 1 when the door 30 is moved towards the second rest position, but further movement is hindered since the second roll 2' is yet not substantially depleted.

In the situation depicted in FIG. 2, a user urges the door 30 towards the second rest position. Hence, the mechanical connection arrangement 60 between the door 30 and the lever arrangement 40 will transfer the movement of the door 30 along the dispensing opening 20 to a pivoting movement of the lever 42 about the pivot axis 44 and towards the second support 14. Since the movement of the door 30 is linked to the pivoting of the lever 42, it is understood that the door 30 may only be moved as far as the lever 42 is able to pivot inside the dispenser 1.

When, as illustrated in FIG. 2, the lever 42 hits the remaining material of the second roll 2', further movement of the door 30 towards the second rest position is hindered.

Hence, when the thickness of the remaining amount of material (and any core) on the second roll 2' is greater than the minimum radius r2 between the second support 14 and the lever 42 in the second end position, the lever 42 cannot reach the second end position, and the door 30 cannot be moved further towards the second rest position. When the door 30 is released from this position, the lever 42 will move by action of the biasing element 50 so as to reassume its home position (FIG. 1). The mechanical connection 60 between the door 30 and the lever arrangement 40 provides for that when the lever 42 moves towards its home position, the door 30 is simultaneously moved back to the first rest position.

Hence, an attempt to move the door 30 towards the second rest position before the second roll is sufficiently depleted, will lead to automatic return of the door 30 to the first rest position.

FIG. 3 illustrates the dispenser of FIGS. 1 and 2, when the door 30 is moved towards the second rest position, and further movement of the door 30 is enabled due to the second roll 2' being substantially depleted.

That the second roll 2' is substantially depleted implies here that the thickness of said second roll 2' is less than the minimum radius r2 between the second support 14 and the lever 42 in the second end position. When this is the case, the material remaining on the roll 2' will not hinder movement of the lever 42 all the way to the second end position.

As will be understood from FIGS. 1 and 3, a ratio between the minimum radius r2 from the second support 14 to the lever 42 when the lever is in its second end position (FIG. 3), and the minimum radius r2 when the lever 42 is in the home position (FIG. 1), is relatively small indicating that most of the material on the roll 2' has been used up. For example, said ration may be less than 10%, preferably less than 5%, most preferred less than 1%.

The mechanical arrangement 60 between the lever arrangement 40 and the lid 30 is configured such that further movement of the door 30 (from FIG. 3) towards the second rest position allows the lever 42 to assume the home position as illustrated in FIG. 4.

Hence, when the second roll 2' is sufficiently depleted, moving the door 30 from the first rest position to the second rest position implies initially moving the lever 42 all the way to the second end position and further movement of the door 30 implies release of the lever 42 to assume the home position. When the lever 42 is released, the door 30 may rest in the second rest position as illustrated in FIG. 4. When the door 30 is in the second rest position, dispensing from the first roll 2 arranged on the first roll support 12 is enabled.

If desired, a user attendant may refill the dispenser by replacing the depleted second roll 2' with a new roll 2'. In this case, the door 30 may stay in the second rest position, ensuring that the users will deplete the first roll 2 sufficiently before the door 30 is moved again for dispensing from the new, unused second roll 2'.

The above description with reference to FIGS. 1 to 4 applies mutatis mutandis when the lid is to be moved from the second rest position to the first rest position.

Optionally, and as illustrated in FIGS. 1 to 4, the mechanical connection 60 may be performed by a cam surface 32 and a cam follower 46.

The cam surface 32 may be designed to accomplish the desired connection between linear movement of the door 30 along the dispensing opening 20 and the associated pivotal movement of the lever 42 from the home position, and subsequent release of the lever arrangement 40 implying return of the lever 42 to the home position.

To this end, the cam surface 32 may extend generally along the length dimension L of the dispenser.

Figure 5:
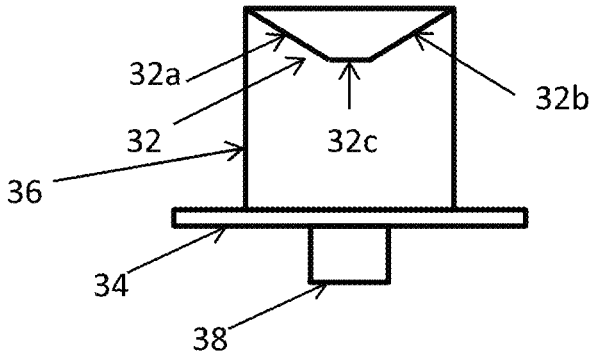
FIG. 5 illustrates a variant of a door provided with a cam surface for use in a dispenser.

Optionally, and as illustrated in FIGS. 1-4, and as best seen in FIG. 5, the cam surface 32 comprises, as seen along the length dimension L, a first ramp surface 32*a* for accomplishing the pivoting of the lever from the home position towards the first end position, and a second ramp surface 32*b* for accomplishing the pivoting of the lever from the home position towards the second end position. Optionally, and as illustrated in the Figures the cam surface 32 further comprises a dwell surface 32*c* extending between the first and second ramp surfaces 32*a*, 32*b*.

With ramp surface is meant a surface being inclined in relation to the intended direction of movement of the cam, i.e. in relation to the intended direction of movement of the door, generally being the length direction of the housing. Such a ramp surface may cooperate with the cam follower so as to provide for pivoting of the lever.

With dwell surface is meant a surface being generally parallel to the intended direction of movement of the cam, i.e. in relation to the intended direction of movement of the door 30, generally being the length direction of the housing 10. Such a dwell surface may cooperate with the cam follower 46 so as to provide for a maintained position of the lever 42. As such, a dwell surface 32*c* may be used to provide for the lever 42 being maintained in a pivoted position, e.g. the first or second end position, while the door 30 is moved along the dispensing opening 20.

In FIGS. 1-5 the cam surface 32 is illustrated as a surface generally opposing the dispensing opening 20. Such a cam surface 32 may be realised in various manners, for example by forming a protruding ridge or an indentation.

Other alternatives for the configuration of the cam surface 32 and the cam follower 46 as known in the art may be used to provide the desired function of the mechanical connection arrangement 60.

For example, to control the movement of the lever 42, abutment stops may be provided for abutment with the lever 42 and/or its cam follower 46 at the end positions. Optionally, a guiding element, e.g. in the form of a ridge in the housing 10 cooperating with the lever 42 and/or its cam follower 46 may be provided to guide the movement of the lever 42 between the end positions. Such a ridge may from abutment stops as mentioned in the above.

In the variants illustrated by the Figures, the mechanic connection arrangement 60 disconnects the door 30 and the lever arrangement 40 when the door 30 is in the rest positions. Other variants are possible where the mechanic connection arrangement 60 connects the door 30 and the lever arrangement 40 also when the door is in the rest positions.

Optionally, and as illustrated in FIGS. 1-5, the door 30 comprises a door portion 34 extending essentially in a plane along the length L and width W dimensions, and a cam portion 36 extending essentially in a plane along the length L and height H dimensions, the cam portion 36 comprising the cam surface 32. Optionally, and as illustrated in FIGS. 1-5, the door 30 is provided with a handle 38 for facilitating grasping by a user.

FIG. 5 is, as mentioned in the above, a schematic figure of a variant of a door 30.

Figure 6:
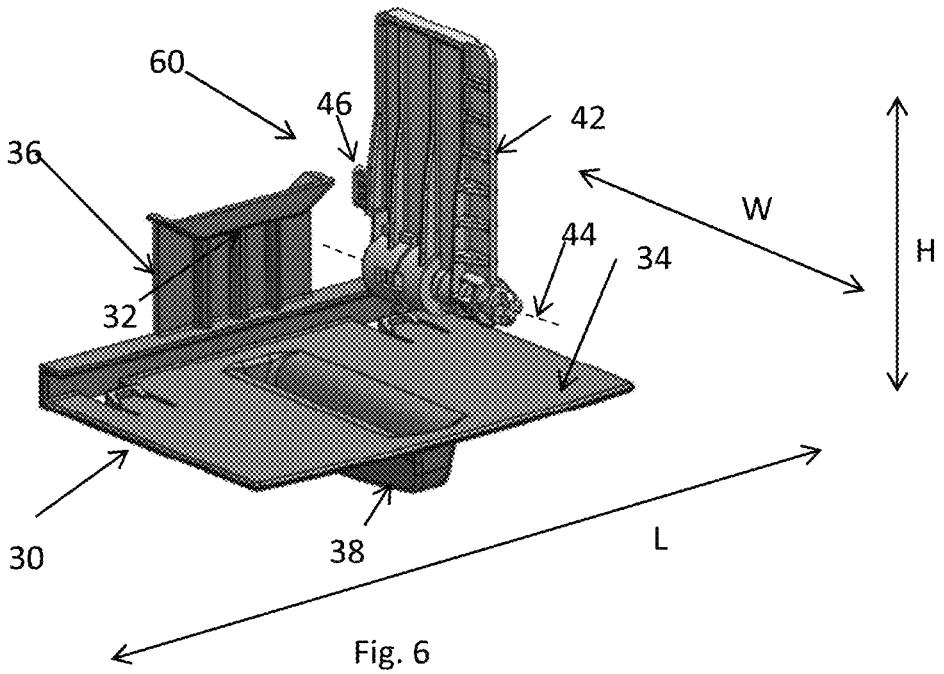
FIG. 6 illustrates another variant of a door and a lever arrangement for use in a dispenser.

FIG. 6 is a more detailed view of parts of a door 30 and lever arrangement 40 for use in a dispenser 1 as described in the above. Reference numerals in FIG. 6 being similar to reference numbers used in FIGS. 1-5 denotes similar features having a similar function. In FIG. 6 it may be seen how the lever 42 at the end adapted for pivotable connection around a pivot axis 44, is provided with an extension for housing a plunger with a torsional spring forming the biasing element 50.

(The reference numerals relating to the door portion 34, the cam portion 36, and the handle 38 has been omitted for better visibility of other features in FIGS. 2-4.)

Figure 7:
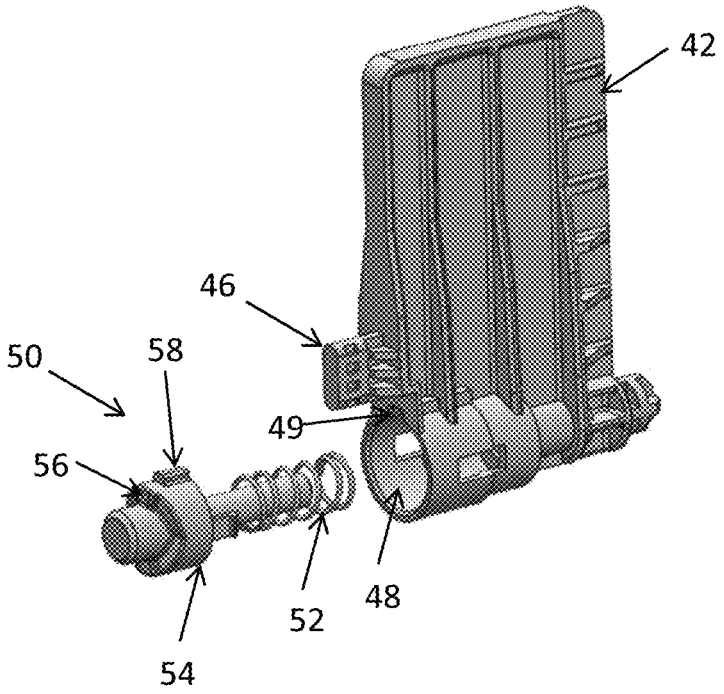
FIG. 7 illustrates the lever arrangement of FIG. 6 with a variant of a biasing arrangement.

FIG. 7 illustrates an embodiment of a biasing arrangement 50 as arranged with to the lever arrangement 40 illustrated in FIG. 6. In this variant, the biasing arrangement comprises a compression spring 52 and a plunger 54. The compression spring 52 and plunger 54 are configured to be arranged in a compartment 48 formed in conjunction with the lever 42. In the illustrated variant, the compartment 48 is constituted by a hollow portion in the end of the lever 42.

The plunger 54 may be configured to be connected to the lever 42 so as to pivot with the pivoting of the lever 42 about the pivot axis 44. In the illustrated embodiment, the plunger 54 comprises a protrusion 58, and the inner wall of the compartment 48 comprises a corresponding indentation 49. The connection transferring pivotal movement of the lever 42 to the plunger 54 is in this embodiment accomplished by the protrusion 58 being arranged in said indentation 49.

Further, the plunger 54 is configured to be arranged such that pivoting of the plunger 54, implies axial displacement of the plunger 54 along the pivot axis 44, causing the compression spring 52 to compress or expand depending on the direction of said axial displacement. In particular, the plunger 54 is arranged so as to be displaceable towards the compression spring 52 upon pivoting the lever 42 towards either of the first and second end positions.

Figure 8:
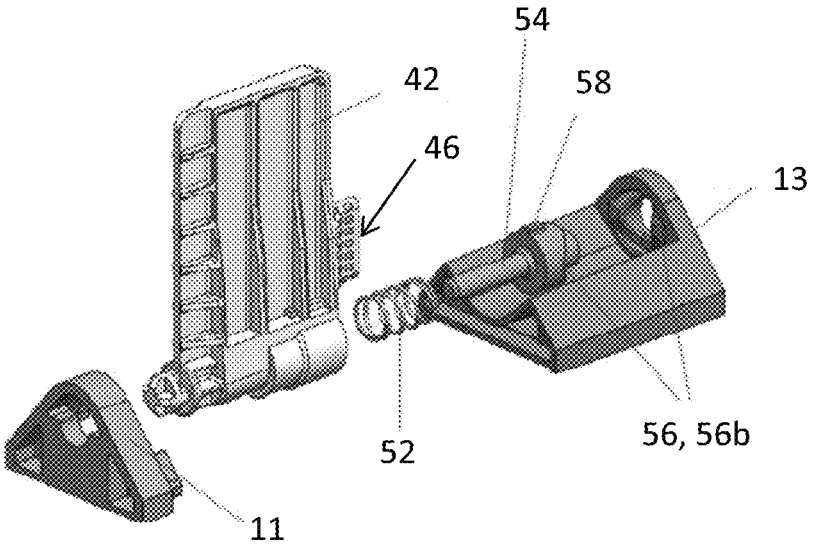
FIG. 8 illustrates the lever and biasing arrangements of FIG. 7.

As seen in FIG. 8, in the illustrated embodiment, said axial displacement is accomplished by a cam surface 56 of the plunger 52, cooperating with another cam surface 56*b*, which in this case is formed in a first part 13 of the housing 10.

In FIG. 8 it is moreover illustrated how the lever 42 is arranged to be pivotable about the pivot axis 44 by means of a second part 11 of the housing 10, generally opposing said first part 13 of the housing 10.

As the skilled person will realise, several variants for forming a biasing arrangement 50 using a plunger 54 and a compression spring 52 as outlined in the above are conceivable.

Moreover, other variants for forming the biasing arrangement 50 may comprise one or more torsion springs.

Figure 9:
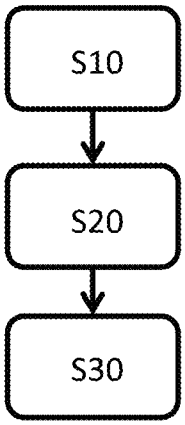
FIG. 9 is a flow chart illustrating a method for setting the dispenser from a first state allowing dispensing from a first roll of absorbent paper material supported by the first support to a second state allowing dispensing from a second roll of absorbent material.

FIG. 9 is a flow chart indicating the steps of a method for the setting a of a dispenser 1 in accordance to the previous claims, from a first state allowing dispensing from a first roll 2 of absorbent paper material supported by the first support 12 to a second state allowing dispensing from a second roll 2' of absorbent material, supported by the second support 14. The method comprises a first step S10 of moving the door 30 from the second rest position towards the first rest position implying the pivoting of the lever 42 against the bias of the biasing element 50 such that the lever 42 is urged towards the first end position, and, when the remaining amount of rolled absorbent paper of the first roll 2 provided on the first support 12 has a radius from the first support 12 being less than the minimum radius r1 between the first support 12 and the lever 42 when in the first end position, such that the lever 42 reaches the first end position, i.e. when the first roll 2 is sufficiently depleted, performing a second step S20 of continuing to move the door 30 towards the first rest position, implying that the lever 42 reassumes the home position and the door 30 reaches the first rest position, enabling dispensing from the second roll 2' arranged on the second support 14 via the dispensing opening 20.

Hence, after performance of the two steps S10 and S20, the dispenser will be set with the door in the first rest position, enabling dispensing from the full second roll 2', but not from the depleted first roll 2.

Optionally, the method comprises the additional step S30 of arranging a new first roll 2 on the first support 12 while the door 30 remains in the first rest position. Upon refilling the dispenser with a new first roll 2 on the first support 12, there is hence no need for further moving the door 30. Instead, the door 30 is already in the first rest position, ensuring that the second roll 2' is used up before the door 30 may be moved again and dispensing from the new, first roll 2 is enabled.

Numerous variants and options of the dispensers disclosed herein will be conceivable by the person skilled in the art.

The invention claimed is:

1. A dispenser for rolls of absorbent paper, the dispenser comprising:

a housing configured to house at least two rolls and defining a length dimension and a width dimension, perpendicular to the length dimension, the housing comprising:

a first support for rotatably supporting a first roll of said at least two rolls, and a second support, for rotatably supporting a second roll of said at least two rolls, the first and second supports being spaced apart from each other as seen along the length dimension; and the dispenser further comprising:

a dispensing opening extending along the length dimension, and a door arranged in relation to the dispensing opening, the door being configured to be movable along the length dimension between a first rest position, in which dispensing of material from the first roll when provided on the first support is hindered by the door, and a second rest position, in which dispensing of material from the second roll when provided on the second support via the dispensing opening is hindered by the door, wherein the dispenser further comprises a lever arrangement and a biasing element, the lever arrangement comprising a lever being configured to be pivotable about a pivot axis, which pivot axis is fixedly arranged in relation to the housing, at a position between the first and second supports as seen along the length dimension;

the biasing element being configured to urge the lever towards a home position, and the lever being configured to be pivotable against the bias of the biasing element from the home position to a first end position, in which a minimum radius from the first support to the lever is shorter than in the home position, and the lever being configured to be pivotable against the bias of the biasing element from the home position to a second end position, in which a minimum radius from the second support to the lever is shorter than in the home position; and the dispenser further comprising a mechanical connection arrangement between the door and the lever arrangement, the mechanical connection arrangement being configured such that when the door is in the first rest position, the lever is in the home position, and when the door is in the second rest position, the lever is in the home position, and unrestricted movement of the door from the first rest position to the second rest position along the dispensing opening is linked to pivoting the lever against the bias of the biasing element from the home position to the second end position, when a second roll is sufficiently depleted; and subsequently releasing the lever to reassume the home position; and unrestricted movement of the door from the second rest position to the first rest position along the dispensing opening is linked to pivoting the lever against the bias of the biasing element from the home position to the first end position, when a first roll is sufficiently depleted; and subsequently releasing the lever to reassume the home position.

2. The dispenser according to claim 1, wherein a ratio between the minimum radius from the first support to the lever when the lever is its first end position, and said minimum radius when the lever is in the home position, is less than 10%.

3. The dispenser according to claim 1, wherein the door and the lever arrangement constitute the mechanical connection arrangement.

4. The dispenser according to claim 1, wherein the mechanical connection arrangement comprises a cam surface associated with the door and a cam follower associated with the lever, wherein preferably the cam surface extends along the length dimension.

5. The dispenser according to claim 4, wherein the cam surface comprises, as seen along the length dimension a first ramp surface for accomplishing the pivoting of the lever from the home position towards the first end position, and a second ramp surface for accomplishing the pivoting of the lever from the home position towards the second end position, and the cam surface further comprises a dwell surface extending between the first and second ramp surfaces.

6. The dispenser according to claim 4, wherein the door comprises a door portion extending essentially in a plane along the length and width dimensions, and a cam portion extending essentially in a plane along the length and height dimensions, the cam portion comprising the cam surface.

7. The dispenser according to claim 1, wherein, in the home position, the lever extends from the pivot axis and substantially along a height dimension, perpendicular to the length dimension and width dimension.

8. The dispenser according to claim 1, wherein the pivot axis is located centrally between the first and second supports, as seen along the length dimension.

9. The dispenser according to claim 1, wherein the pivot axis is arranged between the dispensing opening and the first and second supports, as seen along a height dimension.

10. The dispenser according to claim 1, wherein the lever extends between two end portions, and is connected to the pivot axis at one of the two end portions, the lever being configured as a straight bar.

11. The dispenser according to claim 1, wherein the biasing element comprises a spring element.

12. The dispenser according to claim 11, wherein said spring element is a compression spring arranged to be compressed upon pivoting of the lever towards the first or second end positions.

13. The dispenser according to claim 1, further comprising at least two rolls of absorbent material.

14. A method for the setting of a dispenser according to claim 1, from a first state allowing dispensing from a first roll of absorbent paper material supported by the first support to a second state allowing dispensing from a second roll of absorbent material, supported by the second support, the method comprising:

moving the door from the second rest position towards the first rest position implying the pivoting of the lever against the bias of the biasing element such that the lever is urged towards the first end position, and, when the remaining amount of rolled absorbent paper of the first roll provided on the first support has a radius from the first support being less than the minimum radius between the first support and the lever when in the first end position, such that the lever reaches the first end position, continuing moving the door towards the first rest position, implying that the lever reassumes the home position and the door reaches the first rest position, enabling dispensing from the second roll arranged on the second support via the dispensing opening.

15. The method according to claim 14, further comprising arranging a new first roll on the first support while the door remains in the first rest position.

16. The dispenser according to claim 1, wherein a ratio between the minimum radius from the second support to the lever when the lever is in its second end position, and said minimum radius when the lever is in the home position, is less than 10%.

* * * * *